United States Patent [19]

Lewis et al.

[11] Patent Number: 4,733,812

[45] Date of Patent: Mar. 29, 1988

[54] INSTALLATION TOOL FOR ROOF GUTTERS

[76] Inventors: Don Lewis, 2813 Headland, St. Charles, Mo. 63301; Roy E. Evans, 1709 Seven Pines Dr., St. Louis, Mo. 63146

[21] Appl. No.: 49,279

[22] Filed: May 13, 1987

[51] Int. Cl.[4] ..... B25C 1/02

[52] U.S. Cl. ..... 227/147; 227/148

[58] Field of Search ..... 227/147, 140, 148, 156

[56] References Cited

U.S. PATENT DOCUMENTS

| | | | |
|---|---|---|---|
| 482,540 | 9/1892 | Brown | 227/147 |
| 2,587,944 | 3/1952 | Williams | 227/147 X |
| 2,588,738 | 3/1952 | Lundgren | 227/147 |
| 2,774,969 | 12/1956 | Samples | 227/147 |
| 2,798,220 | 7/1957 | Welby | 227/147 |
| 2,845,103 | 7/1958 | Sypher | 145/46 |
| 3,112,488 | 12/1963 | Dettloff et al. | 227/127 |
| 3,883,064 | 5/1975 | Hilgers | 227/147 X |
| 4,179,058 | 12/1979 | Yost | 227/147 |
| 4,483,475 | 11/1984 | Whitaker | 227/147 |
| 4,676,424 | 6/1987 | Meador et al. | 227/147 |

*Primary Examiner*—Paul A. Bell

*Attorney, Agent, or Firm*—Gravely, Lieder & Woodruff

[57] ABSTRACT

A tool for driving gutter nails through the ends of gutter brackets to secure a gutter to a gutter board includes a nail guide which engages a bracket of the gutter and holds a gutter nail and a nail driver which when struck with a hammer delivers the impact to the nail and drives it from the guide. When engaged with the bracket, the nail guide aligns the nail with holes in the end of the bracket, so that the driven nail passes through the end of the bracket and into the gutter board.

15 Claims, 9 Drawing Figures

INSTALLATION TOOL FOR ROOF GUTTERS

BACKGROUND OF THE INVENTION

This invention relates in general to the installation of roof gutters and more particularly to a tool for driving nails to secure such roof gutters.

The typical roof gutter consists of nothing more than a narrow strip of sheet metal rolled into a trough and reinforcing brackets fitted between the front and rear walls of the trough. Of course a complete gutter also includes transitions to accommodate changes in direction, such as at corners, caps to plug its ends where necessary, and spouts which open into rain leaders. But for the most part, the typical gutter is the sheet metal trough and the reinforcing brackets.

The reinforcing brackets, while being formed from the same metal is the trough, are considerably more rigid, and well they should be, for they tie the front and rear walls together and prevent the latter from deforming outwardly under heavy loads of water or ice. Furthermore, the brackets, being the most rigid part of the gutter, serve as ideal locations for securing the otherwise somewhat filmsy trough to a fascia or gutter board. The end of a typical bracket doubles back on itself to receive the back wall of the trough, and to secure the gutter a nail is driven through this doubled back end as well as through the captured rear wall of the trough and thence into the gutter board. The projecting trough makes wielding a hammer along the back wall of the trough quite difficult, and the nearby horizontal section of the bracket only compounds the problem. Moreover, the lower course of roof shingles often laps downwardly into the gutter itself and obscures the rear wall of the trough and the doubled back portions of the brackets which capture it. When this condition exists, the shingles must be lifted upwardly to drive the nails.

Nail driving tools currently exist which somewhat facilitate the securement of traditional metal gutters. The typical tool consists of nothing more than a tube through which a punch extends, the latter being somewhat longer than the former, so it will project out of one of the ends of the tube. The nail, on the other hand, fits into the opposite end of the tube with its head presented toward the punch. With the nail so fitted, the tube is aligned with the holes in the doubled back portion of the bracket and the punch is struck with a hammer. The punch transfers the impact to the nail which is driven into the gutter board to secure the gutter.

The traditional nail driving tool is difficult to manipulate, particularly from a perch well above the ground on a ladder. The problem resides in aligning the tube with the holes in the doubled back portion of the bracket while at the same time striking the punch with a hammer.

DESCRIPTION OF THE DRAWINGS

In the accompanying drawings which form part of the specification and wherein like numerals and letters refer to like parts wherever they occur

DETAILED DESCRIPTION

Figure 1:
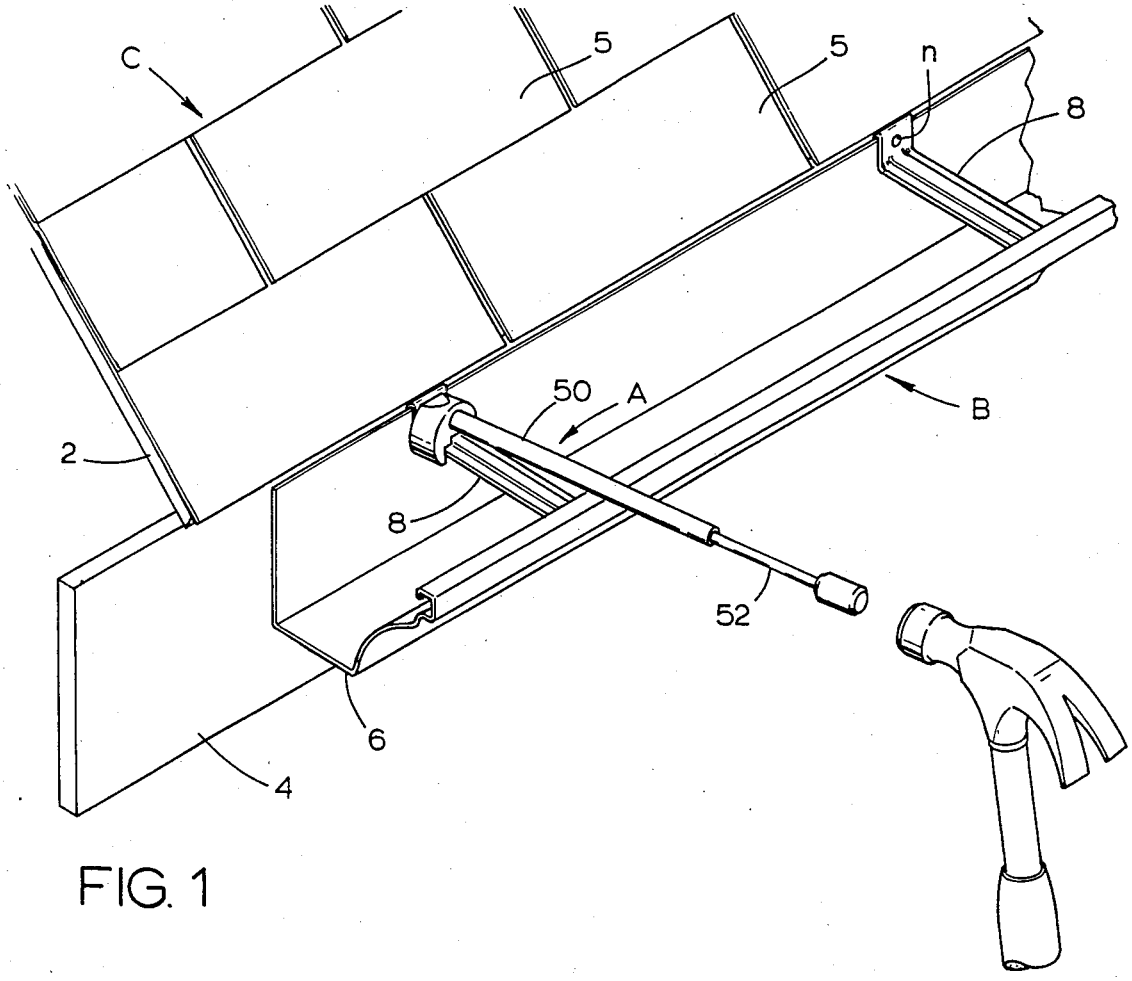
FIG. 1 is a perspective view of a roof and gutter showing the installation tool of the present invention being used to secure the gutter to a gutter board.

Referring now to the drawings, a tool A (FIGS. 1 & 2) facilitates the installation of a gutter B along the lower edge of the roof structure C for a building, particularly at the height at which most gutters are normally located. Actually, the tool A facilitates driving the nails n (FIG. 7) which secure the gutter B to the building, in that it aligns the nail n with the location at which it is to be driven and further enables the hammer strikes which actually drive the nail n to be delivered in front of the gutter B where it is relatively simple to wield a hammer.

The roof structure C to which the gutter B is attached is conventional and includes (FIGS. 1 & 7) sloping roof sheeting 2 which extends downwardly to a fascia or gutter board 4 that is located along the eve of the roof C or else at the upper edge of the wall on which the roof C rests. Nailed to the roof sheeting 2 are shingles 5 which may project beyond the lower edge of the roof C slightly, and thus may lap downwardly a short distance over the gutter board 4. The gutter B is secured to the gutter board 4 with gutter nails n.

The gutter B, which is conventional, includes (FIGS. 1 & 7) a sheet metal trough 6 and reinforcing brackets 8 which traverse the trough 6 to prevent it from deforming. The sheet metal of the trough 6, which is typically aluminum, but may be copper or galvanized steel as well, is roll formed into the trough-like configuration. As such, the trough 6 has a back wall 10, a bottom wall 12 which projects outwardly from the lower edge of the back wall 10, a front wall 14 which extends upwardly from the lower edge of the bottom wall 12, and a flange 16 which projects inwardly toward the back wall 10 from the upper edge of the front wall 14. In contrast to the back wall 10, the front wall 14 is contoured, it having an oblique lower segment 18 which projects outwardly beyond the outer edge of the bottom wall 12 and a generally vertical rim 20 from which the flange 16 projects. The lower segment 18 merges into the vertical rim 20 at a short horizontal surface or ledge 22 which is located directly below the flange 16. Along its inner edge, the flange 16 has a short downwardly directed lip 24. The lower segment 18 may be curved so that it presents a concave surface outwardly, but even so it is oblique in the sense that its upper edge is located farther from the back wall 10 than its lower edge.

Figure 6:
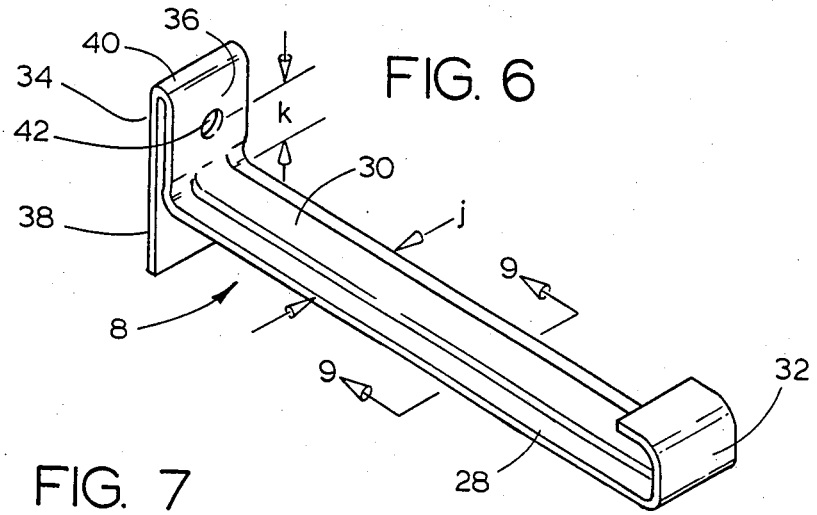
FIG. 6 is a perspective view of the bracket which reinforces the trough of the gutter.

The reinforcing brackets 8 (FIGS. 1, 6, & 7) span the space between the vertical rim 20 and the back wall 10 at the open upper portion of the gutter B and prevent the front wall 14 from distending away from the back wall 10 when the trough 6 is loaded with water or ice. Each reinforcing bracket 8 is formed from the same metal as the trough 6, preferably as a stamping, and includes a cross portion 28 which is preferably embossed in the form of a rib 30 that extends its full length to impart rigidity. The cross portion has a width j. At its outer end the cross portion 28 merges into a front end portion 32 that turns upwardly and then rearwardly to create a hook-like configuration at the outer or front end of the reinforcing bracket 8. The dimensions of the hook-like front end portion 32 are such that it fits snugly into that portion of the trough 6 which is roughly bounded by the ledge 22, the vertical rim 20 and the flange 16, including its lip 24. Indeed, the reinforcing bracket 8 is engaged with the flange 16 of the trough 6 by, in effect, hooking its front end portion into the flange 16 behind the lip 24 of that flange. To this end, the reinforcing bracket 8 is maneuvered into the trough 6 at an oblique angle to place the free end of the hook-like front end portion 32 behind the lip 24 of the flange 16. Then the reinforcing bracket 8 is forced downwardly into a generally horizontal orientation, and as it moves to this position the lower corner of the front end portion 32 slides forwardly over the ledge 22. When, the reinforcing bracket 8 assumes a generally horizontal orientation, the front end portion 32 is captured snugly between the lip 24 and vertical rim 20, on one hand, and the flange 16 and ledge 22 on the other.

At the back or rear end of the reinforcing bracket 8, the cross portion 28 merges into another rear end portion 34 (FIGS. 6–9) which also possesses a hook-like configuration, only the hook opens downwardly. More specifically, the rear end portion 34 has a front segment 36 and a rear segment 38 which are generally parallel and are spaced apart a distance only slightly greater than the thickness of the sheet metal for the trough 6. Both are generally flat and are joined together at a reverse bend 40 in the rear end portion 34. The forward segment 36 projects upwardly from the cross portion 28, and at its upper end merges into the rear segment 38 at the reverse bend 40. The rear segment 38 projects downwardly below the cross portion 28. The forward and rear segments 36 and 38 of the rear end portion 34 have aligned holes 42 located generally midway between the cross portion 28 and the reverse bend 40, and these holes are large enough to accommodate the shank of the nail n. Indeed the aligned holes 42 are located a distance k above the upper surface of the cross portion 28.

As the front end portion 32 of the reinforcing bracket 8 is hooked behind the lip 24 on the flange 16 at the front wall 14 of the trough 6, the cross portion 28 swings downwardly to a horizontal orientation, and upon approaching that position, the back wall 10 of the trough 6 is aligned with the small space between the front and rear segments 36 and 38 of the rear end portion 34. Indeed, the reinforcing bracket 8 is brought downwardly until the reverse bend 40 in the rear end portion 34 comes against the upper edge of the back wall 10. When the reinforcing bracket 8 is so disposed, it ties the back wall 10 and front wall 14 together and prevents the latter from distending with respect to the former.

Figure 7:
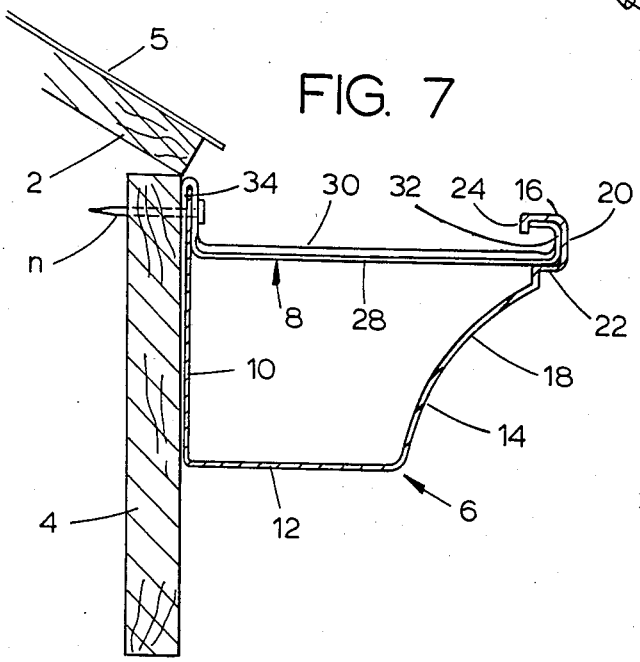
FIG. 7 is a sectional view of a gutter secured to a gutter board with a nail.
Figure 9:
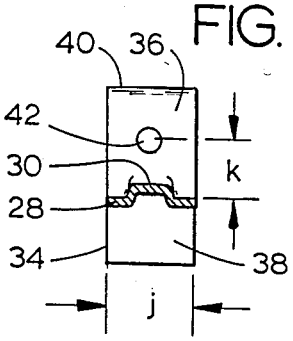
FIG. 9 is a sectional view of the bracket taken along line 9—9 of FIG. 6.

Once the appropriate amount of reinforcing brackets 8 is installed in the trough 6 to complete the gutter B, the gutter B is elevated to the gutter board 4 and secured to the gutter board 4 with the nails n which are driven through the aligned holes 42 in the front and rear segments 36 and 38 of the rear end portion 34 for each reinforcing bracket 8 (FIG. 7). The nails n puncture and pass through the back wall 10 of the trough 6 to lock the trough 6 and bracket 8 together. The shingles 5 of the roof structure C may lap downwwardly over the upper edge of the back wall 10 and the rear end portions 34 of the reinforcing brackets 8 that are along that edge.

By reason of the nearby shingles 5 and cross portions 28 of the reinforcing bracket 8 it is extremely difficult to drive the nails n with merely a hammer. Indeed, the hammer must be wielded in a back hand manner and most likely will strike the cross portion 28 of the reinforcing bracket 8, perhaps bending the reinforcing bracket 8. While it may be easy to start the nail n with a hammer, some type of punch is usually necessary to drive the nail n home, at least when current gutter installation procedures are employed. The gutter installation tool A eliminates these problems.

Figure 8:
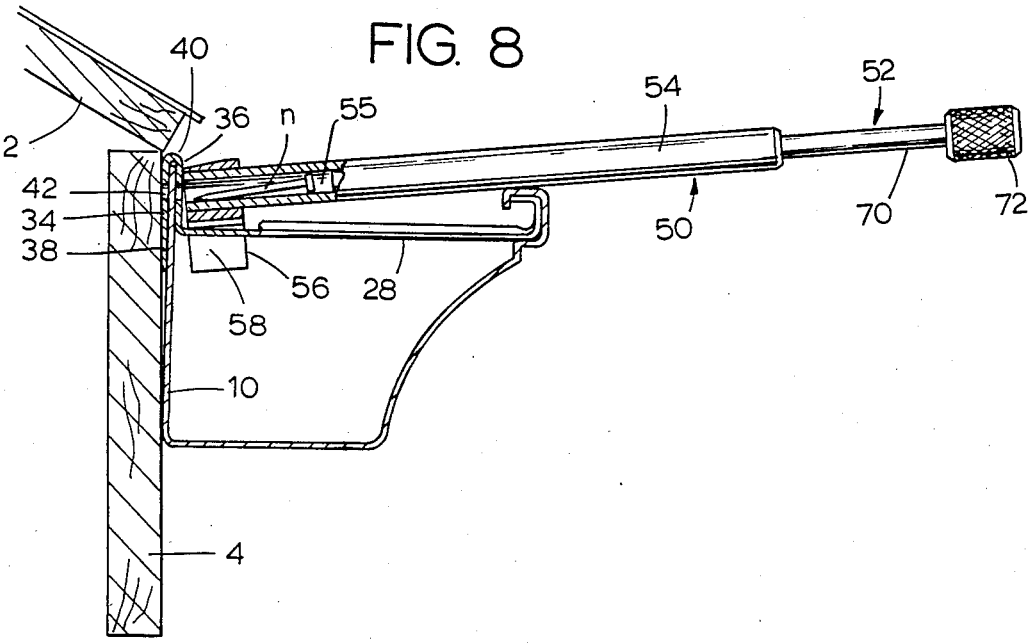
FIG. 8 is a sectional view similar to FIG. 7 but showing the nail driver in position over a bracket of the gutter for driving a nail through the bracket and into the gutter board, the nail guide of the bracket being partially broken away and in section.

The installation tool A includes (FIGS. 2–5) a nail guide 50 and a nail driver 52. The former holds the nail n before it is driven and guides it while it is driven (FIG. 8). As its name implies, the nail driver 52 actually drives the nail n out of the nail guide 50, or more accurately transmits impacts to the nail n so that it will pass through the back wall 10 of the trough 6 and into the gutter board 4.

Figure 5:
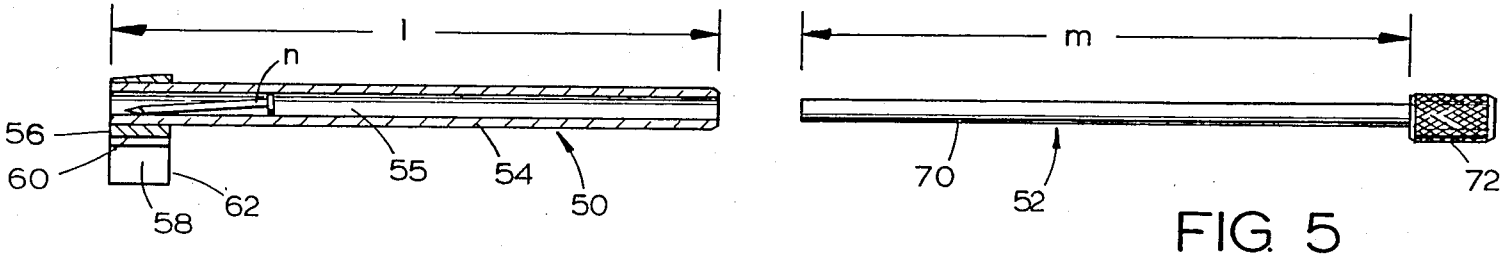
FIG. 5 is a sectional view of the nail guide and the full view of the nail driver taken along line 5—5 of FIG. 3.

The nail guide 50 includes (FIGS. 2–5) a straight guide tube 54 which is somewhat longer than the gutter B is wide, that is to say, it is longer than the reinforcing brackets 8, and further has a bore 55 which extends from the free end of the guide tube 54 to that end face of the head 56 which is presented in the opposite direction, thus having a length 1. In diameter the bore 55 is large enough to loosely accommodate the nail n, both head and shank (FIG. 5). In addition, the nail guide 50 includes a head 56 which is affixed securely to one end of the guide tube 54. Indeed, the head 56 is provided with a bore 55 into which the one end of the guide tube 54 is pressed to join the guide tube 54 and head 56 firmly together. The head 56 projects downwardly from the guide tube 54 and has a downwardly opening cutout 58 located directly below the guide tube 54. The cutout 58 includes a notch 60 which opens downwardly into it, likewise directly below the guide tube 54. The cutout 58, which has a width w, in effect creates a pair of lateral legs 62 on the head 56. The width w of the cutout 58 is only slightly greater than the width j of the cross portion 28 for a reinforcing bracket 8, so that the head 56 will fit over the cross portion 28 of a reinforcing bracket 8 with the legs 62 of the head 56 projecting downwardly on each side of the cross portion 28 to keep the guide 50 from sliding laterally off of the bracket 8. The notch 60, on the other hand, is slightly wider and slightly deeper than the rib 30 that extends through the cross portion 28 of the reinforcing bracket 8, so that when the head 56 is fitted to the reinforcing bracket 8, the notch 60 receives the rib 30.

Figure 2:
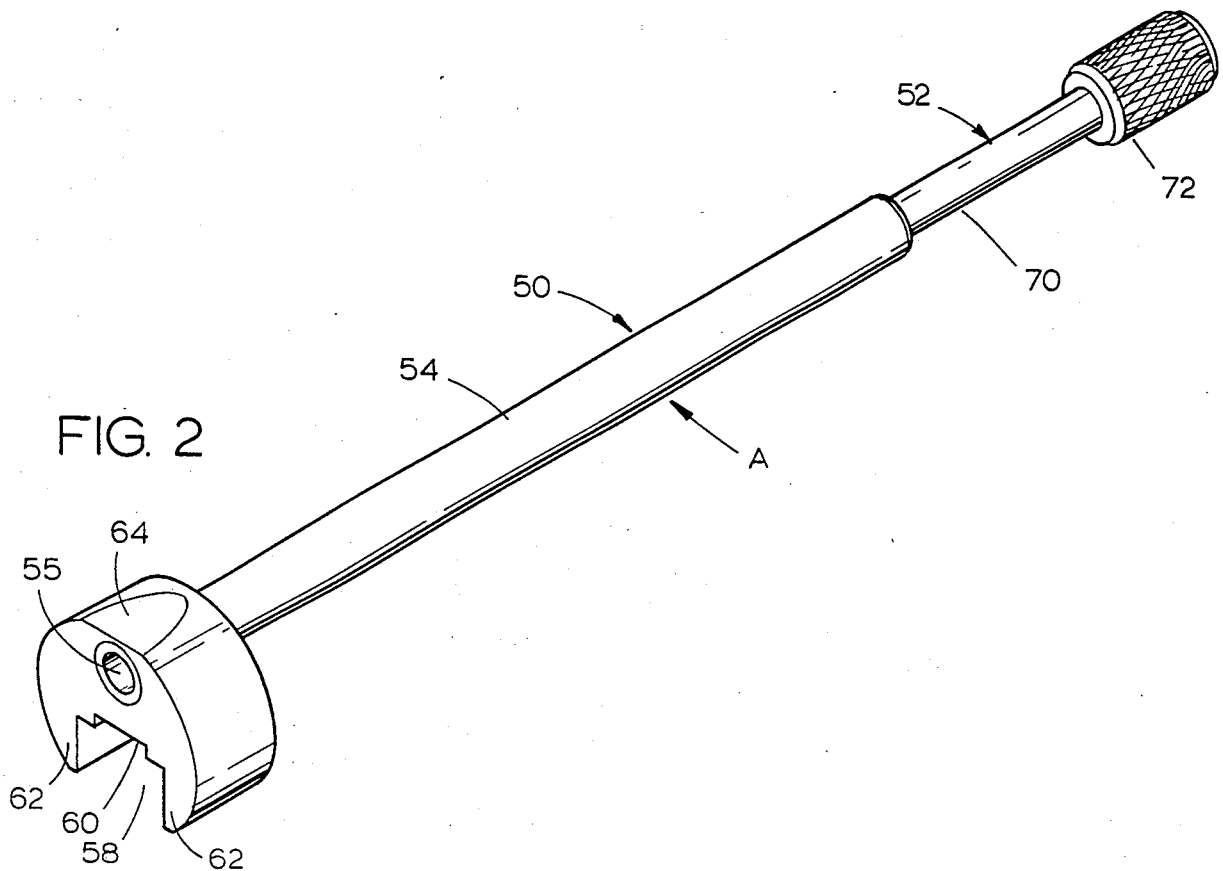
FIG. 2 is a perspective view of the installation tool.
Figure 3:
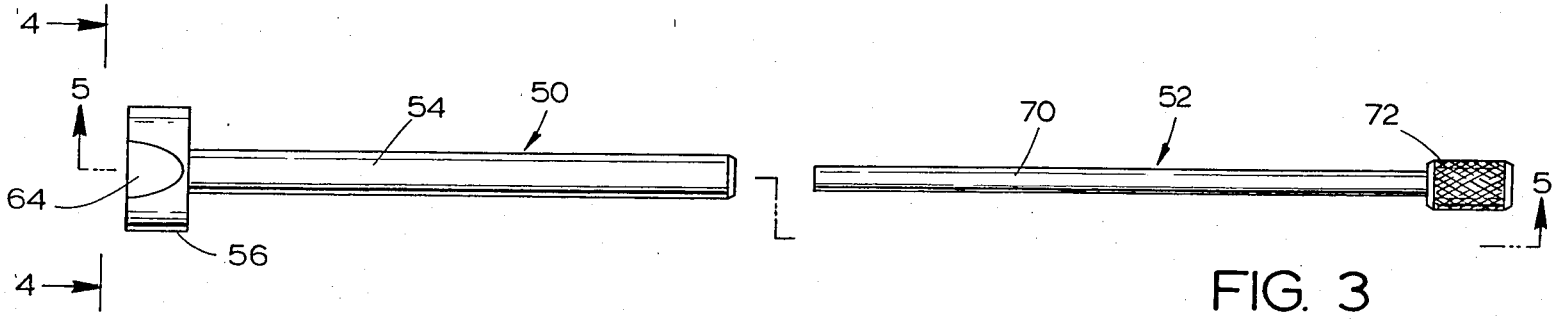
FIG. 3 is a top plan view of the installation tool with the nail driver removed from the nail guide.
Figure 4:
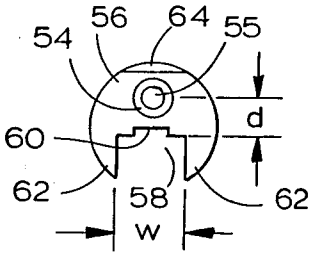
FIG. 4 is an end elevational view of the nail guide taken along line 4—4 of FIG. 3.

When the head 56 is placed over a reinforcing bracket 8 (FIGS. 1 & 8), the horizontal surfaces of the cutout 58 for the head 56 will, on each side of the notch 60, bear against the cross portion 28 of the reinforcing bracket 8 on each side of the rib 30 in that bracket. In short, the cross portion 28 is received in the cutout 58 and the head 56 bears against the cross portion 28 on each side of the rib 30, thus enabling the nail guide 50 to engage the reinforcing bracket 8 (FIG. 1). The distance d between the axis of the guide tube 54 and the upper surfaces of the cutout 58 generally corresponds with the distance k between the centers of the aligned holes 42 in the rear end portion 34 of the reinforcing bracket 8 and the upper surface of the cross portion 28 on the reinforcing bracket 8. Actually the distance d is slightly greater than the distance k. With the head 56 so disposed and the guide tube 54 in a generally horizontal orientation, the bore 55 of the guide tube 54 will generally align with the aligned holes 42 in the rear end portion 34 of the reinforcing bracket 8, although their centers will be slightly offset.

The exterior peripheral surface of head 56 is for the most part arcuate and parallel to the axis of the guide tube 54 except directly over the guide tube 54 where it is beveled downwardly slightly toward that end of the head 56 out of which the guide tube 54 opens, thus forming on the upper portion of the head 56 a beveled land 64 which is oblique to the axis of the bore 55. The beveled land 64 is useful in lifting any shingles 5 that may lap downwardly toward the reinforcing bracket 8 with which the head 56 of the nail guide 50 is engaged.

The nail driver 52 is in effect a punch which includes (FIGS. 3, 5 & 8) a shank 70 and a head 72 at one end of the shank 70. The shank 70 fits into the bore 55 of the guide tube 54 with a slight clearance, so that the shank 70 slides easily within that bore. Moreover, the length m of the shank 70, that is the distance from its free end to the head 72, is only slightly greater, perhaps by as much as .09 inches, than the length 1 of the bore 55. Thus, when the head 72 of the nail driver 52 bottoms out against the free end of the guide tube 54, the free end of the shank 70 will project only slightly beyond the rear end of the head 56 for the nail guide 50. The head 72 of the nail driver 52 projects radially outwardly from the shank 70 and its diameter is somewhat larger than the outside diameter of the guide tube 54 for the nail guide 50. Thus the driver head 72 will not enter the bore 55 of the guide tube 54. The driver head 72 provides a surface for striking the nail driver 52 with a hammer and thereby transmitting the impacts delivered by the hammer to a nail n at the free end of the shank 70 for the nail driver 52.

OPERATION

To hang the gutter B using the gutter installation tool A, the gutter B is raised to the gutter board 4 and secured temporarily with a few nails driven through the back wall 10 of the trough 6 and partially into the gutter board 4. Then, using the tool A, gutter nails n are driven through the rear end portions of all of the reinforcing brackets 8. To this end, the nail driver 52 is retracted somewhat within the bore 55 of the nail guide 50—indeed far enough to enable a nail n to be inserted into the bore 55 from the head end of the nail guide 50. Then with the pointed end of the nail n at the open end of the bore 55, the tool A is maneuvered over the open top of the gutter B, its guide tube 54 being in a generally horizontal orientation and its head 56 being presented toward the gutter board 4. At one of the reinforcing brackets 8, the head 56 is lowered onto the underlying reinforcing bracket 8, so that the cross portion 28 of the reinforcing bracket 8 is received in the cutout 58 of the head 56. When so disposed, the head 56 rests on the cross portion 28 on each side of its rib 30 and the guide tube 50 projects outwardly over the flange 16 of the trough 6 and rests on the flange 16 along the front wall 14 of the gutter trough 6. Thereupon, the nail guide 50 is advanced toward the back wall 10 of the trough 6, and in so doing, the roof shingle 5 immediately above the reinforcing bracket 8 may have to be lifted onto the beveled land 64 of the head 56. In any event, the nail guide 50 is maneuvered rearwardly until its rearwardly presented face comes against the forward segment 36 of the rear end portion 34 for the reinforcing bracket 8. The guide tube 54, on the other hand, is allowed to rest on the flange 16 along the front wall 14 of the trough 6. The guide tube 54 projects forwardly beyond the vertical rim 20 of that front wall 14. When the nail guide 50 is so disposed, the pointed end of the nail n within the bore 55 of the guide tube 54 aligns with the aligned holes 42 in the rear end portion 34 of the reinforcing bracket 8.

To drive the nail n through the back wall 10 of the gutter trough 6 and into the gutter board 4, the head 72 of the nail driver 52 is struck several times with a hammer—indeed until the head 72 of the nail driver 52 bottoms out against the free end of the guide tube 54 for the nail driver 52. This is easily achieved, for the head 72 of the nail driver 52 is located well beyond the front wall 14 of the gutter B where a workman can easily wield a hammer. The hammer impacts applied to the head 72 of the nail driver 52 are transmitted through the shank 70 to the head of the nail n, and thus drive the nail n through the aligned holes 42 in the rear end portion 34 of the reinforcing bracket 8 and into the gutter board 4. After a few strikes with the hammer, the head of the nail n seats tightly against the rear end portion 34 of the reinforcing bracket 8, thus holding the reinforcing bracket 8 and the trough back wall 10 tightly against the gutter board 4.

The remaining reinforcing brackets 8 are secured with nails n in a similar manner.

This invention is intended to cover all changes and modifications of the example of the invention herein chosen for purposes of the disclosure which do not constitute departures from the spirit and scope of the invention.

What is claimed is:

1. A tool for installing on a support structure a roof gutter formed from a sheet metal trough and brackets extended across the open upper end of the trough to reinforce it, said tool comprising: a nail guide having a bore large enough to receive a gutter nail and being configured to fit over a bracket of the gutter said nail guide having a downwardly opening cutout to receive the bracket of the gutter so as to align the bore and a nail within it with a portion of the gutter that is determined by the bracket; and a nail driver extended into the bore and beyond one end of the bore for delivering, when struck, an impact to the nail so as to drive the nail through the roof gutter and into the support structure.

2. A tool according to claim 1 wherein the nail driver includes a shank which fits into the bore of the nail guide and a head at one end of the shank, so that the shank projects from the head and has a free end beyond that head, the driver head being larger in diameter than the bore, and the distance the shank projects axially beyond the head being about equal to the length of the bore, whereby when the head of the driver bottoms out against the nail guide, the shank fully occupies the bore and its free end is located at that end of the bore which aligns with the portion of the gutter determined by the bracket.

3. A tool according to claim 1 wherein the nail guide includes a head having the cutout therein and a tube extending from the head and having the bor within it.

4. A tool according to claim 3 wherein the nail driver includes a shank which fits into the bore of the tube and a head at one end of the shank, so that the shank projects from the driver head and has a free end beyond that head, the driver head being larger in diameter than the bore and the distance that the shank projects axially beyond the driver head being about equal to the length of the bore, so that when the driver head bottoms out agianst the tube at which one end of the bore is located, the shank will occupy substantially the entire bore and its free end will be located at the opposite end of the bore.

5. A tool according to claim 4 wherein the shank is slightly longer than the bore.

6. A tool according to claim 4 wherein the bore of the nail driver opens out of the tube at the driver head and that head above the bore is provided with a surface that is beveled downwardly toward the axis of the bore in the direction that the bore opens out of the head, so that the beveled surface will support roof shingles above the bracket.

7. A tool according to claim 4 wherein the tube extends through the driver head and has one end flush with an end surface of that head.

8. In combination with a roof gutter including a sheet metal trough having spaced apart front and back walls and a bottom wall connecting the front and back walls and further including brackets which extend transversely between the front and back walls to connect those walls near the open top of the trough, a tool for driving gutter nails through the gutter and into a gutter board along which the gutter is positioned with its back wall against that board, all to secure the gutter to the gutter board, said tool comprising a nail guide having within it a bore that is large enough to receive a gutter nail and being configured to engage a bracket said nail guide including a head provided with a downwardly opending cutout which is configured to receive a cross portion of said bracket to thereby enable said guide to engage said bracket, so as to align the bore and the nail within it with a portion of the gutter that is determined by the bracket; and driver means for delivering impacts to the nail that is within the bore so as to drive the nail through the portion of the gutter with which the bore is aligned and into the gutter board.

9. The combination according to claim 8 wherein each bracket has a cross portion which extends transversely across the open top of the trough and a rear end portion which is connected to the back wall of the trough; and wherein the nail guide engages the bracket at its cross portion and aligns the end of its bore with the rear end portion of the bracket.

10. The combination according to claim 9 wherein the rear end portion of the bracket has a hole and the nail guide when properly engaged with the cross portion of the bracket generally aligns the end of its bore with the hole in the rear end portion of the bracket.

11. The combination according to claim 10 wherein the rear end portion of the bracket has a front segment which extends upwardly from the cross portion and a rear segment which extends downwardly from the upper end of the front segment, wherein the hole is in both of the segments; and wherein the back wall of the trough is captured between the two segments.

12. The combination according to claim 11 wherein driver means includes a nail driver which fits into and slides easily within the bore and projects out of that end of the bore which is remote from the rear end portion of the bracket.

13. The combination according to claim 12 wherein the nail driver includes a shank which fits into the bore of the nail guide and a head at one end of the shank, so that the shank projects from the head and has a free end beyond the head, the driver head being larger than the bore and the distance that the shank projects axially beyond the head being about equal to the length of the bore, so that when the driver head bottoms out against the nail guide where one end of the bore opens out of the guide, the free end of the shank will be at the opposite end of the bore.

14. The combination according to claim 9 wherein the nail guide further includes a tube which projects outwardly from one end of the bracket and terminates at a free end, the length of the nail guide measured from the opposite end of the head to the free end of the tube being greater than the space between the back and front walls of the trough so that when the head of the nail guide is engaged with the cross portion of the bracket and against the rear end portion of the bracket, the tube will project outwardly beyond the front wall of the trough.

15. The combination according to claim 14 wherein the head above the bore has a lifting surface which with respect to the axis of the bore is beveled downwardly toward that end of the bore which is at the head so that the lifting surface will support shingles that may overlap the gutter board.

* * * * *